US008007090B2

(12) United States Patent
Wieland et al.

(10) Patent No.: US 8,007,090 B2
(45) Date of Patent: Aug. 30, 2011

(54) INK-SUPPLY CARTRIDGE FOR PRINTER ROLL

(75) Inventors: Rainer Wieland, Würzburg (DE); Peter Schmitt, Würzburg (DE)

(73) Assignee: KBA-Metronic AG, Veitshochheim (DE)

( * ) Notice: Subject to any disclaimer, the term of this patent is extended or adjusted under 35 U.S.C. 154(b) by 570 days.

(21) Appl. No.: 12/203,284

(22) Filed: Sep. 3, 2008

(65) Prior Publication Data

US 2009/0058965 A1 Mar. 5, 2009

(30) Foreign Application Priority Data

Sep. 4, 2007 (DE) ..... 10 2007 041 756

(51) Int. Cl.
*B41J 2/175* (2006.01)

(52) U.S. Cl. ..... 347/86; 347/85; 101/350.6

(58) Field of Classification Search ..... 347/34, 347/37, 40, 67, 84–87, 108; 101/350.1, 350.6, 101/350.363, 157, 169, 363, 364, 366, 349.1
See application file for complete search history.

(56) References Cited

U.S. PATENT DOCUMENTS

| | | | | |
|---|---|---|---|---|
| 5,182,992 | A | 2/1993 | Rogge | 101/363 |
| 5,596,927 | A | 1/1997 | Maurer et al. | 101/363 |
| 5,862,756 | A | 1/1999 | Gorter | 101/364 |
| 6,035,781 | A | 3/2000 | Rogge et al. | 101/350.6 |
| 6,799,508 | B1 * | 10/2004 | Depond | 101/350.6 |
| 7,234,396 | B2 | 6/2007 | Kleinschnitz | 101/350.6 |
| 2009/0000499 | A1 | 1/2009 | Boose | |

FOREIGN PATENT DOCUMENTS

| | | | |
|---|---|---|---|
| DE | 9405883 | U | 7/1994 |
| DE | 10302288 | A | 8/2004 |
| DE | 102006009084 | A | 9/2006 |
| EP | 0941845 | A | 9/1999 |

* cited by examiner

*Primary Examiner* — Thinh Nguyen

(74) *Attorney, Agent, or Firm* — Andrew Wilford

(57) ABSTRACT

An ink cartridge has a pair of elongated, longitudinally extending, and transversely spaced side plates and a pair of short, transversely extending, and longitudinally spaced end plates bridging the side plates and forming therewith an downwardly open compartment adapted to hold a body of ink. Respective doctor blades extend transversely toward each other from lower edges of the side plates and define a floor of the compartment and a central downwardly open mouth adapted to feed ink from the body to a roll below the compartment. Respective axially spaced flexible bodies carried on the end plates are shiftable between outer positions generally disengaged from axial end edges of the doctor blades and inner positions bearing axially against the axial end edges.

6 Claims, 3 Drawing Sheets

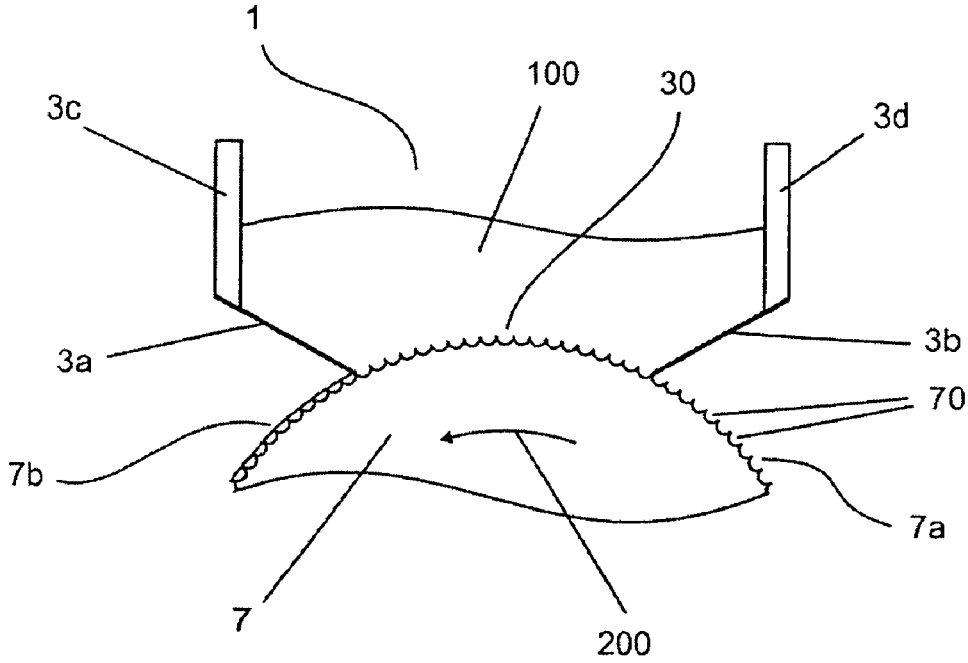
Fig. 1 - Prior art
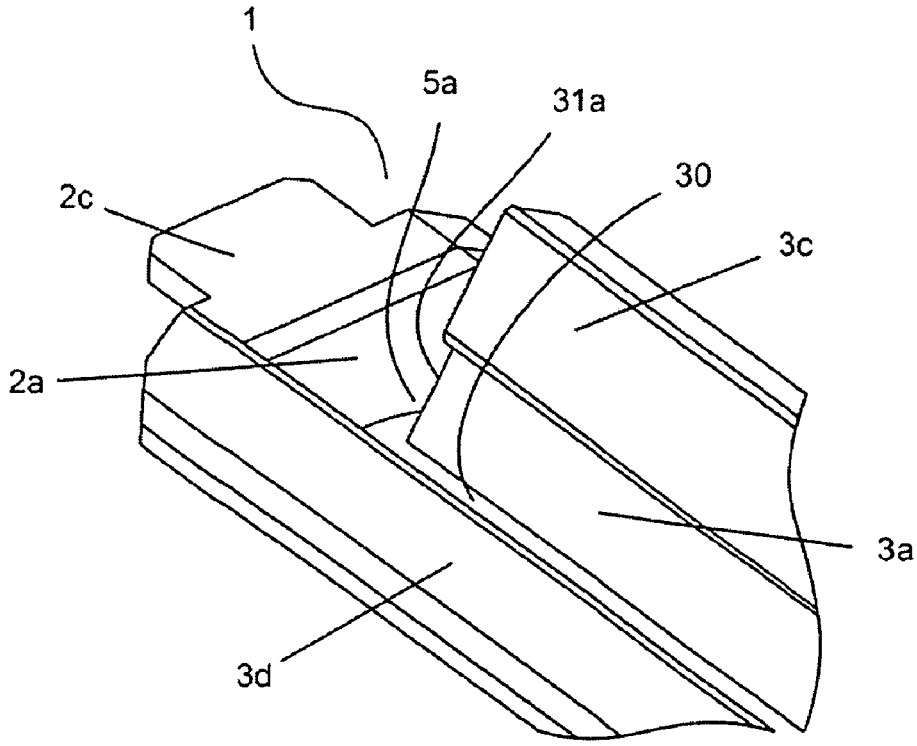
Fig. 2 - Prior art

INK-SUPPLY CARTRIDGE FOR PRINTER ROLL

FIELD OF THE INVENTION

The present invention relates to an ink-supply cartridge. More particularly this invention concerns such a cartridge used to apply ink to a printer roll.

BACKGROUND OF THE INVENTION

The invention relates to an ink cartridge comprising two short, longitudinally spaced, and transversely extending end plates and two long, longitudinally extending, and transversely placed side plates. A respective doctor blade sheet is on each of the side plates, in particular a doctor blade strip. In such an ink cartridge, the end plates and the side plates form a frame or box which encloses a body of a predetermined volume of ink that can pass through a downwardly open mouth of the ink cartridge, between the outer edges of the two doctor blades, onto a roll of a printer.

Printers and lacquering machines for the printing or lacquering of sheet-like printing substrates have been in commercial use for many years. Because the subject matter of the invention may be used in printers and also in lacquering machines, all descriptions below relate to printers as well as to lacquering machines, without limiting use.

Of these printers, one type operates according to a rotary printing principle, for example a flexographic, offset, letterpress, rotogravure process, etc., in which the print master of the image to be printed is cut into an outer surface of one or more printing cylinders, or in the form of a printing plate is clamped onto the outer surface of a printing cylinder, and during the printing process the print image is transferred, either directly or via a downstream transfer cylinder, to the printing substrate by rolling the printing cylinder over its outer surface.

To this end, the print master on the printing cylinder is inked by one or more inking units so that the ink-transferring areas of the print master are uniformly inked upon each revolution of the printing cylinder, thereby ensuring essentially uniform print quality on the printing substrate.

For uniform print quality, it is crucial that, regardless of the printing speed, the inker continuously supplies the same quantity of printing ink in the form of a homogeneous ink film to an inking cylinder, from which the printing ink is conveyed via the print master to the printing substrate. For producing such an ink film it is common to withdraw a given quantity of printing ink from an ink cartridge, using a anilox roll, for example, by partially immersing the outer surface of the anilox roll in the printing ink provided in the ink cartridge, and when the anilox roll rotates about its cylindrical axis a specified quantity of printing ink is conveyed from the ink cartridge.

To this end, the anilox roll has multiple recesses, for example cups or grooves, on its outer surface which take in the printing ink. Excess printing ink on the outer surface of the anilox roll is advantageously scraped by the downstream doctor blade from the outer surface of the anilox roll when the anilox roll rolls out of an ink cartridge, and the scraped-off printing ink remains in the ink cartridge.

By predetermining the total volume of all recesses or cups in the anilox roll during manufacture thereof, it is possible in each case to take only a specified quantity of printing ink from the ink cartridge. However, for this type of ink withdrawal it is problematic that the ink cartridge is sealed with respect to the anilox roll, in particular in the region of the top surfaces of the anilox roll cylinder, at the end face edges of the doctor blade sheets facing the end plates of the ink cartridge.

Since the doctor blades rest on the outer surface of the anilox roll under pretension, and likewise must follow any imbalance of the anilox roll, it is not possible to fixedly connect the doctor blades to the end plates, so that a gap remains with respect to the end plates through which printing ink can leak out of the ink cartridge.

In particular for ink cartridges situated above the anilox roll, and/or when low-viscosity printing inks are used, there is a risk that printing ink may leak out and pass uncontrolled into the printing unit in unacceptable quantities. It is also common to remove the ink cartridge together with its contents from a printing unit in order to operate a printing unit using another printing ink, or for cleaning or maintenance purposes, for example.

To this end, as disclosed in U.S. Pat. No. 7,234,396 for example, at least one of the doctor blades is displaced along the anilox roll surface in such a way that the outer edges of the doctor blades come to rest one on top of the other and the mouth of the ink cartridge is closed off with respect to the outer surface of the anilox roll. However, for closable ink cartridges of this type or also of other types, there are additional gaps between the end edges of the doctor blades and the end plates, through which printing ink can emerge in an uncontrolled manner.

OBJECTS OF THE INVENTION

It is therefore an object of the present invention to provide an improved ink-supply cartridge for a printer roll.

Another object is the provision of such an improved ink-supply cartridge for a printer roll that overcomes the above-given disadvantages, in particular by means of which a gap between an end plate and the end face edge of a doctor blade may be reliably and optionally closed.

Yet another object of the invention is to design the gap to be closable in such a way that there is little or no hindrance of the mobility of the doctor blades.

SUMMARY OF THE INVENTION

An ink cartridge has according to the invention a pair of elongated, longitudinally extending, and transversely spaced side plates and a pair of short, transversely extending, and longitudinally spaced end plates bridging the side plates and forming therewith an downwardly open compartment adapted to hold a body of ink. Respective doctor blades extend transversely toward each other from lower edges of the side plates and define a floor of the compartment and a central downwardly open mouth adapted to feed ink from the body to a roll below the compartment. Respective axially spaced flexible bodies carried on the end plates are shiftable between outer positions generally disengaged from axial end edges of the doctor blades and inner positions bearing axially against the axial end edges.

The flexible bodies may preferably be set in the end plates at least in the region of the end face edges of the doctor blades, optionally over a large surface area.

Pressing the flexible bodies out of an end plate toward end edges of doctor blades may be achieved by displacement and/or deformation of the flexible bodies, for example by impingement of force or pressure on these flexible bodies, so that they are moved, at least in places, toward end edges of the respective doctor blades, thus closing the gaps between these edges and the end plates.

To this end, for example, a device may be provided in an end plate by means of which the respective flexible body may be impinged on by a force or pressure from a side facing away from the respective doctor blade. In this manner the body is displaced and/or deformed so that the gap is tightly closed. The body itself is preferably of elastic material in order to provide sealing characteristics. The flexible body may be made of vulcanized rubber, an elastomer, unvulcanized rubber, or a composite material.

Such a design may be used for ink cartridges having stationary doctor blades, as well as for ink cartridges in which at least one of the doctor blades is movable to close the ink cartridge so that, for example, the ink cartridge may be removed from a mount or seat in a printing unit. In this manner the gaps necessary for movement of the doctor blades are thus closed with respect to the end plates, so that printing ink cannot leak out at this location.

For accommodating the flexible body, each end plate has a corresponding recess in which the body is compressed, in particular seamlessly embedded. The design may be such that in a first position the surface of the flexible body is flush with an inner planar face of the respective end plate, on the side facing the doctor blade.

By use of a corresponding device on the side of the flexible body facing away from the doctor blade, for example by means of an eccentric roller or an eccentric cam, the flexible body may be displaced and/or deformed, at least in places, for example in its center region, out of its neutral outer position into a second inner position until its surface facing the doctor blade contacts the end edge of the doctor blade, thereby closing the gap between the end plate and the doctor blade.

Depending on the application and design of the flexible body, it may be practical to close the gaps only when the ink cartridge is removed from the printer, or also during normal operation of the ink cartridge in the printer.

BRIEF DESCRIPTION OF THE DRAWING

The above and other objects, features, and advantages will become more readily apparent from the following description, reference being made to the accompanying drawing in which:

FIG. 1 is a schematic section through a prior-art ink cartridge;

FIG. 2 is a perspective view of the prior-art FIG. 1 ink cartridge;

SPECIFIC DESCRIPTION

Figure 3:
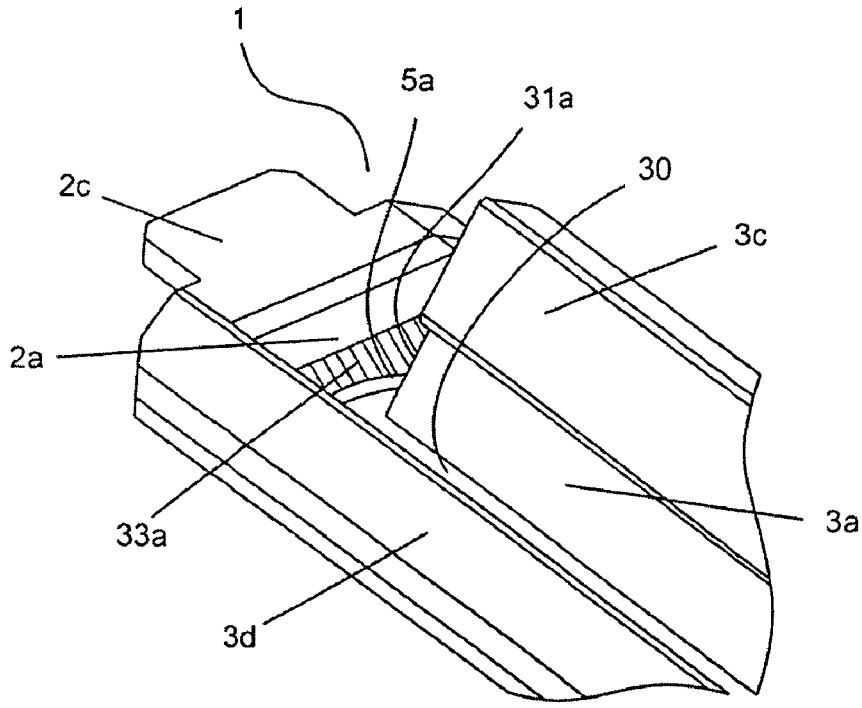
FIG. 3 shows a schematic sectional illustration of an ink cartridge having a lateral seal according to the invention.

As seen in FIG. 1 an ink cartridge 1 comprises two flat, vertical, and basically planar side plates 3*c* and 3*d* to whose lower edges respective doctor blades 3*a* and 3*b* are attached, as well as end plates 2*a* and 2*b* (FIG. 2). The plates 2*a*, 2*b*, 3*c*, and 3*d* together form an essentially rectangular, in particular frame-shaped, top piece that defines a mouth 30 at the bottom by means of the doctor blades 3*a* and 3*b* and the end plates 2*a* and 2*b* adapted to the surface 7*a* of the anilox roll 7.

The frame-shaped top piece may be fastened to a mounting 2*c* which at the same time may be provided for fastening the ink cartridge in the printer.

The size and shape of the mouth 30 is adapted to the corresponding anilox roll 7 in such a way that when the mouth 30 is placed on top of an outer surface 7*a* of a anilox roll 7 the mouth 30 is closed by the anilox roll 7. Printing ink 100 that passes from the interior of the ink cartridge 1 into this region 30 on the outer surface 7*a* of the anilox roll 7*a* fills cavities 70 formed in the outer surface 7*a* of the anilox roll 7.

Rotation of the anilox roll 7 about its cylindrical axis in a direction 200 causes the surface 7*a* of the anilox roll 7 to be doctored by the downstream doctor blade 3*a*, and a layer 7*b* of ink intended for the printing process remains only in the cups 70. Due to the fact that the doctor blades 3*a* and 3*b* rest on the surface 7*a* of the anilox roll 7 under a certain mechanical tension to allow optimal doctoring of the printing ink 100 from the outer surface 7*a*, thereby leveling out any imbalance of the anilox roll 7, it is not possible to fixedly connect the doctor blades 3*a* and 3*b*, in particular at their end edges 31*a* and 31*b*, to the end plates 2*a* and 2*b*, so that in this region the opening or gap 5*a* or 5*b* remains between the end plates 2*a* and 2*b* and the doctor blades 3*a* and 3*b*.

Figure 4:
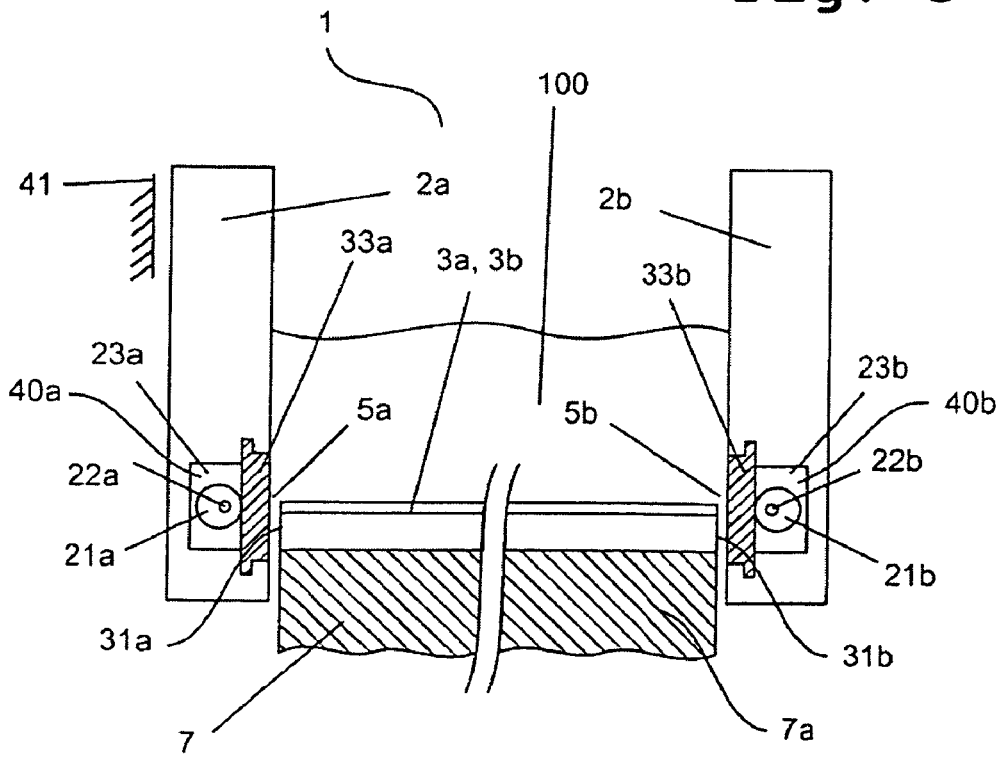
FIG. 4 is a view like FIG. 1 of the cartridge according to the invention in a first or outer position.

FIGS. 3 and 4 schematically show a first inventive embodiment of a seal according to the invention for an ink cartridge in a first or outer position. The ink cartridge 1 comprises the previously described two end plates 2*a* and 2*b* and two side plates 3*c* and 3*d*, in addition to the doctor blades 3*a* and 3*b*, which together form an essentially rectangular box in which a body 100 of printing ink is provided.

The oppositely situated doctor blades 3*a* and 3*b* form a mouth 30 through which the printing ink 100 is transferred to a anilox roll 7. When the ink cartridge 1 is installed its normal operating position in a schematically illustrated seat 41 in the printer, as shown in FIG. 4, the doctor blades 3*a* and 3*b* rest on the surface 7*a* of the anilox roll 7, so that the mouth 30 is closed downward by the anilox roll 7. Printing ink 100, which in this region inside the ink cartridge 1 reaches the surface 7*a* of the anilox roll 7, also penetrates and fills the cups 70 thereon.

When the anilox roll 7 rotates about its cylindrical axis in direction 200, the doctor blades 3*a* and 3*b* doctor the surface 7*a* of the anilox roll 7. When the anilox roll rotates out of the ink cartridge 1 excess printing ink 100 is retained in the ink cartridge 1. In this manner only a given quantity of printing ink 100, specified by the total volume of the cups 70, in the surface 7*a* of the anilox roll 7 is continuously conveyed from the ink cartridge 1, and is available for the subsequent printing process.

However, as shown in FIG. 2, there is no seal, or only an inadequate seal, at regions 5*a* and 5*b* between the end plates 2*a* and 2*b* and the end edges 31*a* and 31*b* of the doctor blades 3*a* and 3*b*, so that printing ink leak outs uncontrolledly in these regions and is able to pass into the printer.

Even when the ink cartridge 1 is removed from the printing unit, in which case the mouth 30 is closed by moving the doctor blades 3*a* and 3*b* toward one another, as described in U.S. Pat. No. 7,234,396, the distance of the regions 5*a* and 5*b* from the end plates 2*a* and 2*b* remains unchanged, so that these gaps or openings continue to be present, and printing ink can leak out uncontrolledly from the ink cartridge.

According to the invention, therefore, a flexible body 33*a* and 33*b* that in particular is flexible is provided at each of the end plates 2*a* and 2*b* in the region of the end edges 31*a* and 31*b* of the doctor blades 3*a* and 3*b*, so that the flexible bodies

33*a* and 33*b* may be deformed or displaced toward the end edges 31*a* and 31*b* by use of a respective actuator 40*a* and 40*b*.

According to the invention, the deformation or displacement may be performed with such force that the respective surfaces of the flexible material 33*a* and 33*b* contact the edges 31*a* and 31*b* and close the openings 5*a* and 5*b*. To this end, the end plates 2*a* and 2*b* have actuators 40*a* and 40*b* that are comprised basically of eccentric roller cams 21*a* and 21*b*, for example, which is supported so as to be rotatable about a rotational axis 22*a* and 22*b*, and whose respective outer surfaces act on the associated flexible material 33*a* and 33*b*. FIG. 4 shows the eccentric roller cams 21*a* and 21*b* in a first position in which little or no force is exerted on the flexible material 33*a* and 33*b*, so that there is little or no displacement and/or deformation of the flexible material toward the edges 31*a* and 31*b*, thus forming an opening 5*a* and 5*b* between the edges 31*a* and 31*b* and the flexible material 33*a* and 33*b*.

Figure 5:
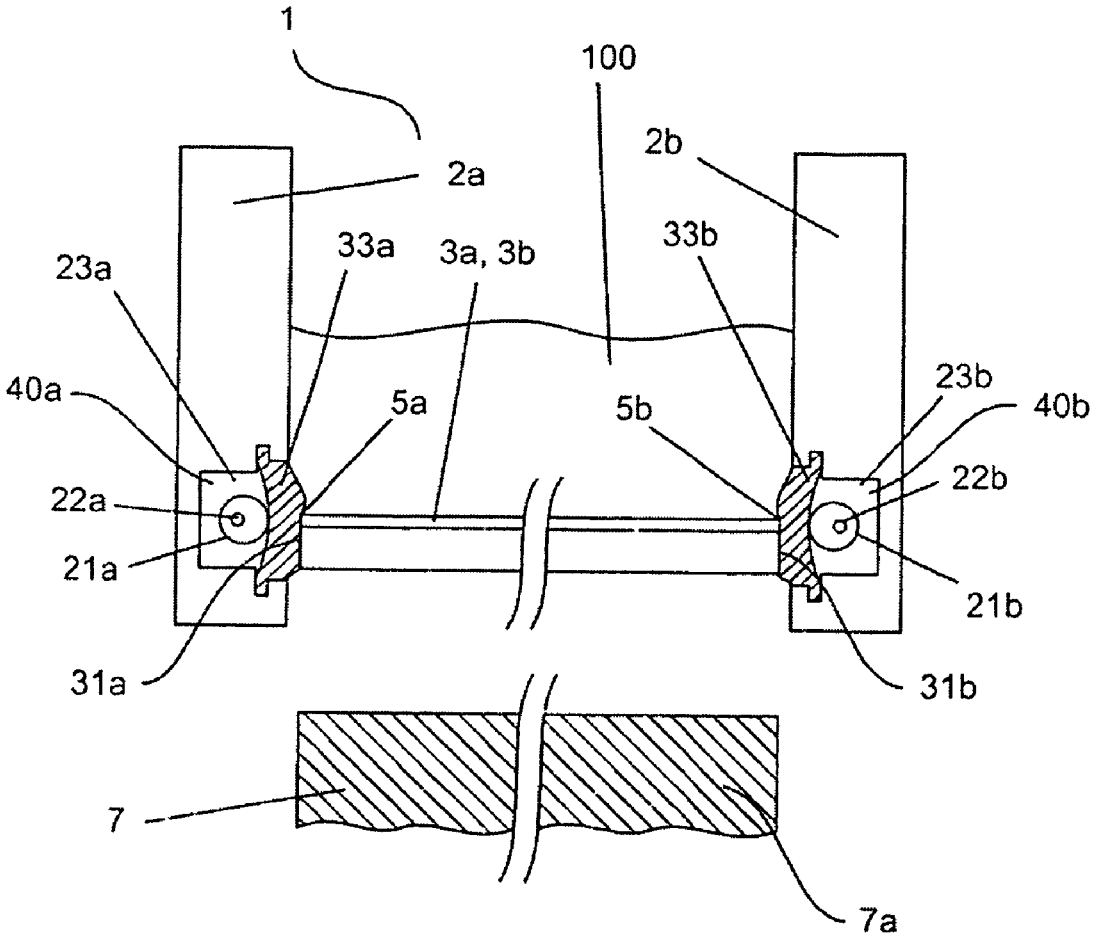
FIG. 5 is a top view showing the cartridge of this invention in a second or inner position.

In contrast, FIG. 5 shows the eccentric roller cams 21*a* and 21*b* in a second position in which a force is exerted on the respective flexible material 33*a* and 33*b* via the outer surfaces of the eccentric roller cams, thereby displacing and/or deforming the flexible material toward the respective edges 31*a* and 31*b* until the openings 5*a* and 5*b* are closed.

If in this position the ink cartridge 1 is also closed with respect to the anilox roll, for example by means of a device as described in U.S. Pat. No. 7,234,396 or another type of device, the ink cartridge as schematically shown by way of example in FIG. 5 may be removed from the printing unit and from the anilox roll without printing ink being able to leak out at the bottom through an opening that is not closed or is not adequately closed.

With regard to all the embodiments, it is noted that the technical features stated in conjunction with an embodiment can be used not only for that specific embodiment, but also for the other respective embodiments. All disclosed technical features in the description of the invention are considered to be essential to the invention, and may be used in any given combination with one another, or alone.

We claim:

1. An ink cartridge comprising:

a pair of elongated, longitudinally extending, and transversely spaced side plates;

a pair of short, transversely extending, and longitudinally spaced end plates bridging the side plates and forming therewith an downwardly open compartment adapted to hold a body of ink;

respective doctor blades extending toward each other from lower edges of the side plates and defining a floor of the compartment and a central downwardly open mouth adapted to feed ink from the body to a roll below the compartment;

respective axially spaced flexible bodies carried on the end plates and shiftable between outer positions generally disengaged from axial end edges of the doctor blades and inner positions bearing axially against the axial end edges.

2. The ink cartridge defined in claim 1 wherein the end plates are formed with confronting recesses in which the respective flexible bodies are at least partially recessed in the outer positions.

3. The ink cartridge defined in claim 2 wherein the flexible bodies have outer faces turned longitudinally away from each other and engageable with the respective actuators.

4. The ink cartridge defined in claim 1, further comprising respective actuators engaged between the flexible bodies and the respective end plates and operable to shift the bodies between the inner and outer positions.

5. The ink cartridge defined in claim 1, further comprising a seat in which the end and side plates are releasably latchable; and means for unlatching the end and side plates from the seat.

6. The ink cartridge defined in claim 5 wherein the means for unlatching and the actuators are coupled together to move the bodies into the inner position on unlatching of the plates from the seat.

* * * * *